US008579132B2

(12) United States Patent
Wong

(10) Patent No.: US 8,579,132 B2
(45) Date of Patent: Nov. 12, 2013

(54) ANTI-COLIC BABY FEEDING BOTTLE

(75) Inventor: Chung-Lun Wong, Hong Kong (HK)

(73) Assignee: Fu Hong Industries Limited, Hong Kong (HK)

( * ) Notice: Subject to any disclaimer, the term of this patent is extended or adjusted under 35 U.S.C. 154(b) by 76 days.

(21) Appl. No.: 13/202,987

(22) PCT Filed: Feb. 24, 2010

(86) PCT No.: PCT/CN2010/070728
§ 371 (c)(1),
(2), (4) Date: Aug. 24, 2011

(87) PCT Pub. No.: WO2010/097037
PCT Pub. Date: Sep. 2, 2010

(65) Prior Publication Data

US 2011/0303629 A1 Dec. 15, 2011

(30) Foreign Application Priority Data

Feb. 25, 2009 (CN) ..... 2009 1 0126148

(51) Int. Cl.
*A61J 9/04* (2006.01)
*B65D 51/16* (2006.01)

(52) U.S. Cl.
USPC ..... 215/11.5; 215/307; 215/310

(58) Field of Classification Search
USPC ..... 215/11.5, 307, 310
See application file for complete search history.

(56) References Cited

U.S. PATENT DOCUMENTS

| | | | | | |
|---|---|---|---|---|---|
| 1,998,646 | A | * | 4/1935 | Yager | 215/11.5 |
| 2,628,616 | A | * | 2/1953 | Ransom | 215/11.5 |
| 2,736,446 | A | | 2/1956 | Raiche | |
| 2,980,113 | A | * | 4/1961 | Sappey et al. | 215/11.5 |
| 4,613,050 | A | * | 9/1986 | Atkin et al. | 215/11.5 |
| 5,797,505 | A | * | 8/1998 | Kaura | 215/11.5 |
| 5,881,893 | A | * | 3/1999 | Manganiello | 215/11.5 |

(Continued)

FOREIGN PATENT DOCUMENTS

| | | | |
|---|---|---|---|
| CN | 2060070 | U | 8/1990 |
| CN | 101584646 | A | 11/2009 |
| CN | 201379806 | Y | 1/2010 |
| EP | 1297814 | A1 | 4/2003 |

OTHER PUBLICATIONS

Search Report of European Patent Application No. 10745821.8.
International Search Report of PCT/CN2010/070728.

*Primary Examiner* — Mickey Yu
*Assistant Examiner* — Niki Eloshway

(57) ABSTRACT

An anti-colic baby feeding bottle (10) includes a bottle body (16) having a bottle neck (18), a cap (14) removably fastened to the bottle neck (18), and an elastic teat (12). The teat (12) includes a nipple portion (24) having a fluid-dispensing through-hole (26) and an annular base (28), an annular flange (30) extending radially outward from the annular base (28), a plurality of apertures (32) formed 360° around the annular flange (30), and an annular skirt (40) depending from the annular base (28). The annular skirt (40) is spaced radially inward apart from an inner surface (42) of the bottle neck (18) to define an annular passage (44) having an outer end (46) in air communication with the apertures (32) and an inner end (48) which is normally closed by biasing force of a free end (50) of the annular skirt (40) that presses against the inner surface (42) of the bottle neck (18).

8 Claims, 9 Drawing Sheets

(56) References Cited

U.S. PATENT DOCUMENTS

| | | | | |
|---|---|---|---|---|
| 6,371,315 | B1 * | 4/2002 | Chien | 215/11.5 |
| 2004/0094499 | A1 * | 5/2004 | Huang | 215/11.5 |
| 2004/0164043 | A1 * | 8/2004 | Hakim | 215/11.5 |
| 2004/0188373 | A1 * | 9/2004 | Lewis et al. | 215/11.5 |
| 2005/0252875 | A1 * | 11/2005 | Sheu et al. | 215/11.5 |
| 2008/0128379 | A1 * | 6/2008 | Hen | 215/11.5 |
| 2010/0163508 | A1 * | 7/2010 | Samson | 215/11.5 |

* cited by examiner

ANTI-COLIC BABY FEEDING BOTTLE

CROSS-REFERENCE TO RELATED APPLICATIONS

This application claims priority of Chinese Patent Application No. 200910126148.9 filed on Feb. 25, 2009, the entire content of which is hereby incorporated by reference.

FIELD OF PRESENT PATENT APPLICATION

The present application relates to an anti-colic baby feeding bottle.

BACKGROUND

Existing anti-colic baby feeding bottles are complicated in structure, difficult to use and clean. Furthermore, a person needs to orient the bottle in a specific direction to achieve the anti-colic effect.

SUMMARY

According to one aspect, there is provided an anti-colic baby feeding bottle including:

a bottle body having a bottle neck;

a cap removably fastened to the bottle neck; and an elastic teat including a nipple portion having a fluid-dispensing through-hole and an annular base, an annular flange extending radially outwardly from the annular base, a plurality of apertures formed 360° around the annular flange, and an annular skirt depending from the annular base;

wherein the annular flange is clamped between an annular top wall of the cap and a rim of the bottle neck, and the annular skirt is spaced radially inwardly apart from an inner surface of the bottle neck to define an annular passage including an outer end in air communication with the apertures and an inner end which is normally closed by biasing force of a free end of the annular skirt that presses against the inner surface of the bottle neck.

In one embodiment, the annular skirt is generally cylindrical in shape.

In one embodiment, the inner surface of the bottle body against which the free end of the annular skirt presses is a radially inwardly bulging annular protrusion.

In one embodiment, the annular skirt has a flared free end.

In one embodiment, the thickness of the flared free end tapers into a point.

In one embodiment, the annular skirt flares from the annular base to the free end.

In one embodiment, the thickness of the annular skirt tapers towards its free end into a point.

In one embodiment, the nipple portion further includes an annular projection which together with the annular top wall of the cap defines an annular air inlet in air communication with the apertures.

In one embodiment, the apertures are formed around the annular flange adjacent to the annular base of the nipple portion.

In one embodiment, the apertures are spaced equidistantly apart around the annular flange.

In one embodiment, the bottle neck is integrally formed with external threads and the cap is integrally formed with internal threads threadably engagable with the external threads.

According to another aspect, there is provided a teat for a feeding bottle including:

a nipple portion having a fluid-dispensing through-hole and an annular base;

an annular flange extending radially outwardly from the annular base;

a plurality of apertures formed 360° around the annular flange; and an annular skirt depending from the annular base;

wherein the annular flange is adapted to be clamped between a bottle neck of a bottle body and a cap removably fastened to the bottle neck, and the annular skirt is spaced radially inwardly apart from an inner surface of the bottle neck to define an annular passage including an outer end in air communication with the apertures and an inner end which is normally closed by biasing force of a free end of the annular skirt that presses against the inner surface of the bottle neck.

In one embodiment, the annular skirt is generally cylindrical in shape.

In one embodiment, the inner surface of the bottle body against which the free end of the annular skirt presses is a radially inwardly bulging annular protrusion.

In one embodiment, the annular skirt has a flared free end.

In one embodiment, the thickness of the flared free end tapers into a point.

In one embodiment, the annular skirt flares from the annular base to the free end.

In one embodiment, the thickness of the annular skirt tapers towards its free end into a point.

In one embodiment, the nipple portion further comprises an annular projection which together with the annular top wall of the cap defines an annular air inlet in air communication with the apertures.

In one embodiment, the apertures are formed around the annular flange adjacent to the annular base of the nipple portion.

In one embodiment, the apertures are spaced equidistantly apart around the annular flange.

Although the feeding bottle disclosed in the present application is shown and described with respect to certain embodiments, it is obvious that equivalents and modifications will occur to others skilled in the art upon the reading and understanding of the specification. The present application includes all such equivalents and modifications, and is limited only by the scope of the claims.

BRIEF DESCRIPTION OF THE DRAWINGS

Specific embodiments of the feeding bottle disclosed in the present application will now be described by way of example with reference to the accompanying drawings wherein.

DETAILED DESCRIPTION

Figure 1:
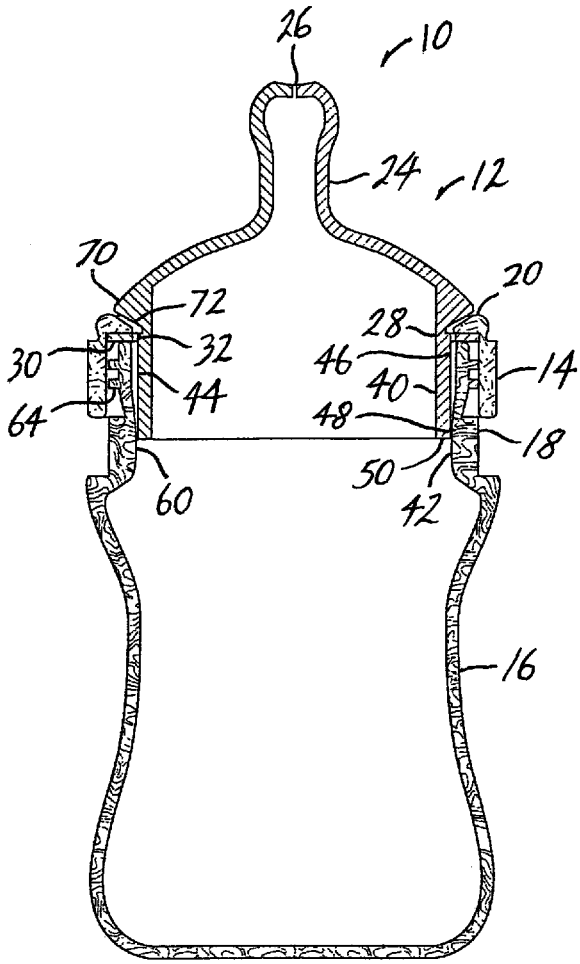
FIG. 1 is a longitudinal cross sectional view of a feeding bottle according to a first embodiment disclosed in the present application.
Figure 2:
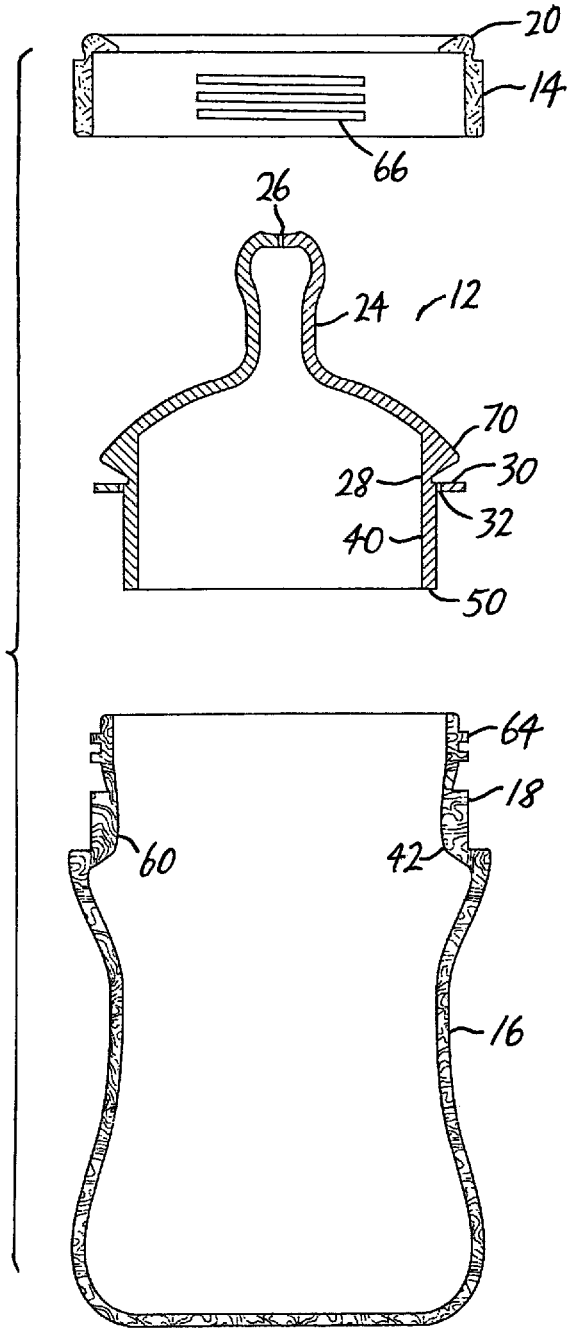
FIG. 2 is an exploded view of the feeding bottle of FIG. 1.
Figure 3:
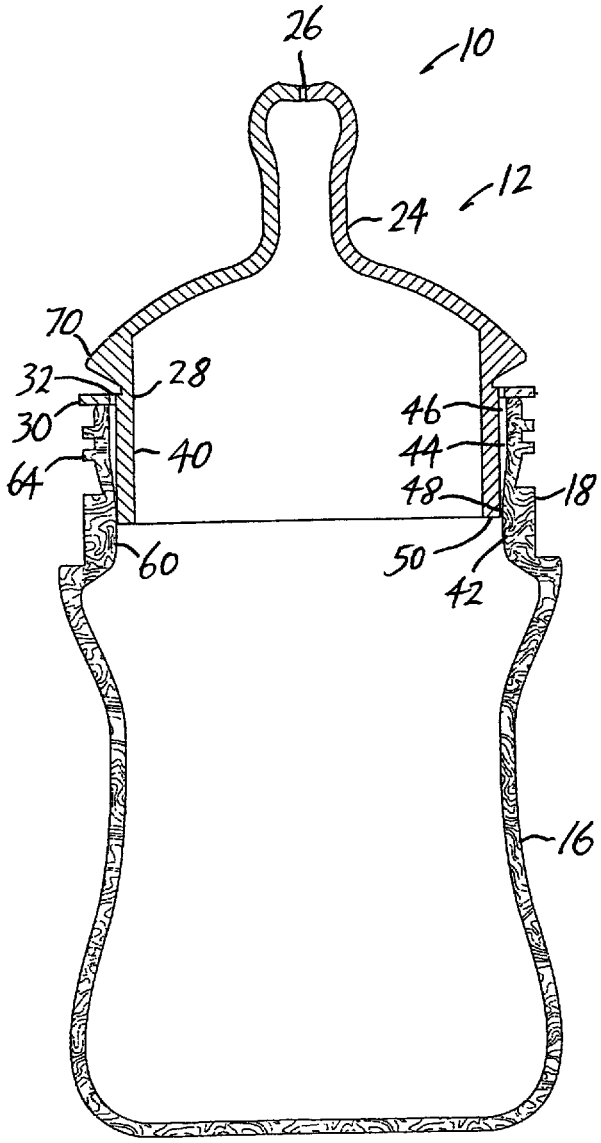
FIG. 3 is a longitudinal cross sectional view similar to that in FIG. 1 without a closure cap.
Figure 4:
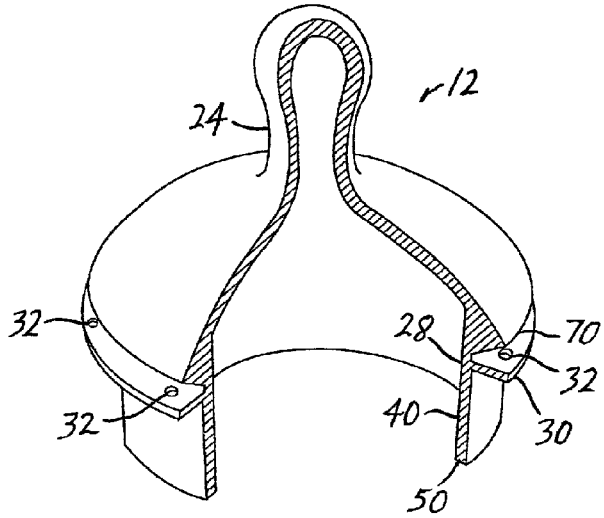
FIG. 4 is a partially cutaway perspective view of the nipple in FIG. 3.
Figure 5:
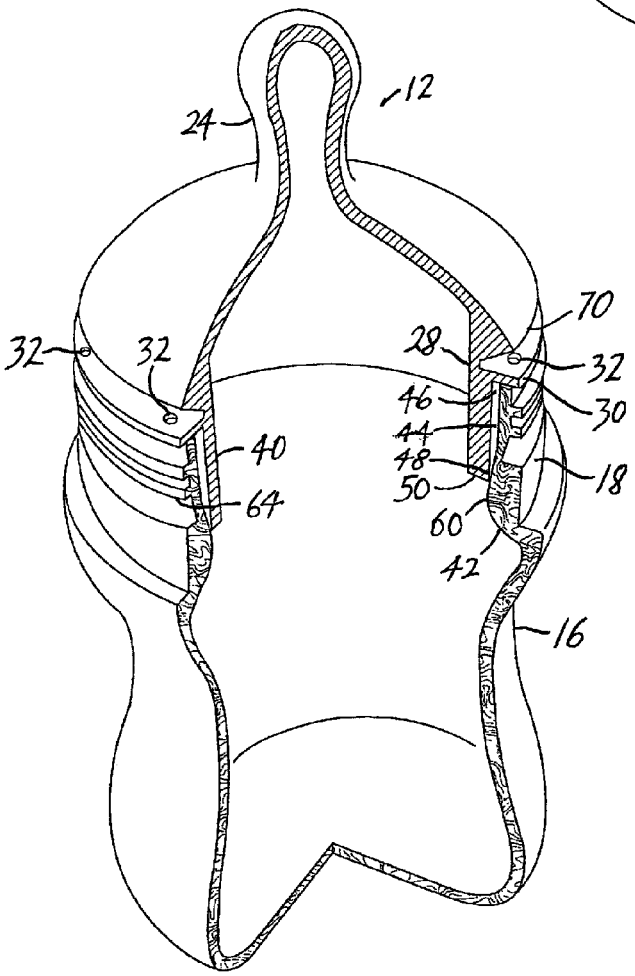
FIG. 5 is a partially cutaway perspective view of the feeding bottle with nipple shown in FIG. 3.

Reference will now be made in detail to a preferred embodiment of the feeding bottle disclosed in the present application, examples of which are also provided in the following description. Exemplary embodiments of the feeding bottle disclosed in the present application are described in detail, although it will be apparent to those skilled in the relevant art that some features that are not particularly important to an understanding of the feeding bottle may not be shown for the sake of clarity.

Furthermore, it should be understood that the feeding bottle disclosed in the present application is not limited to the precise embodiments described below and that various changes and modifications thereof may be effected by one skilled in the art without departing from the spirit or scope of the appended claims. For example, elements and/or features of different illustrative embodiments may be combined with each other and/or substituted for each other within the scope of this disclosure and appended claims.

Certain terminology is used in the following description for convenience only and is not limiting. The words "upper", "lower", "top", and "bottom" designate directions in the drawings to which reference is made. The terminology includes the words noted above as well as derivatives thereof and words of similar import.

FIGS. 1-5 are different views of a first embodiment of an anti-colic baby feeding bottle 10. The anti-colic baby feeding bottle 10 include three parts, namely an elastic teat 12, a cap 14 and a bottle body 16. The bottle body 16 has a bottle neck 18. The cap 14 can be removably fastened to the bottle neck 18 of the bottle body 16. The teat 12 can be securely clamped between an annular top wall 20 of the cap 14 and a rim of the bottle neck 18. The teat 12 may be made of silicone or any other suitable soft and elastic material. The cap 14 and the bottle body 16 may be made of plastic, glass or any other suitable material.

The teat 12 includes a nipple portion 24 having a fluid-dispensing through-hole 26 and an annular base 28. An annular flange 30 may extend radially outwardly from the annular base 28. A plurality of apertures 32 can be formed 360° around the annular flange 30. An annular skirt 40 may depend from the annular base 28 of the nipple portion 24 into the bottle body 16.

The annular skirt 40 can be spaced radially inwardly apart from an inner surface 42 of bottle neck 18 to define an annular passage 44. The annular passage 44 has an outer end 46 in air communication with the apertures 32 and an inner end 48 which is normally closed by biasing force of a free end 50 of the annular skirt 40 pressing against the inner surface 42 of the bottle neck 18.

According to this embodiment, the annular skirt 40 is generally cylindrical in shape. The inner surface of the bottle neck 18 against which the free end 50 of the annular skirt 40 presses is a radially inwardly bulging annular protrusion 60.

The apertures 32 may be formed 360° around the annular flange 30 adjacent to the annular base 28 of the nipple portion 24. The apertures 32 may be spaced equidistantly apart around the annular flange 30. The apertures 32 may be in the shape of a circle or in any other appropriate shapes.

The bottle neck 18 can be integrally formed with external threads 64 and the cap 14 can be integrally formed with internal threads 66 threadably engagable with the external threads 64. Alternatively, the cap 14 can be removably fastened to the bottle neck 18 by any other appropriate fasteners.

The teat 12 may further include an annular projection 70 above the apertures 32 of the annular flange 30. The annular projection 70 together with the annular top wall 20 of the cap 12 defines an annular air inlet 72 in air communication with the apertures 32. The annular air inlet 72 is generally in the shape of an inverted truncated cone.

Figure 6:
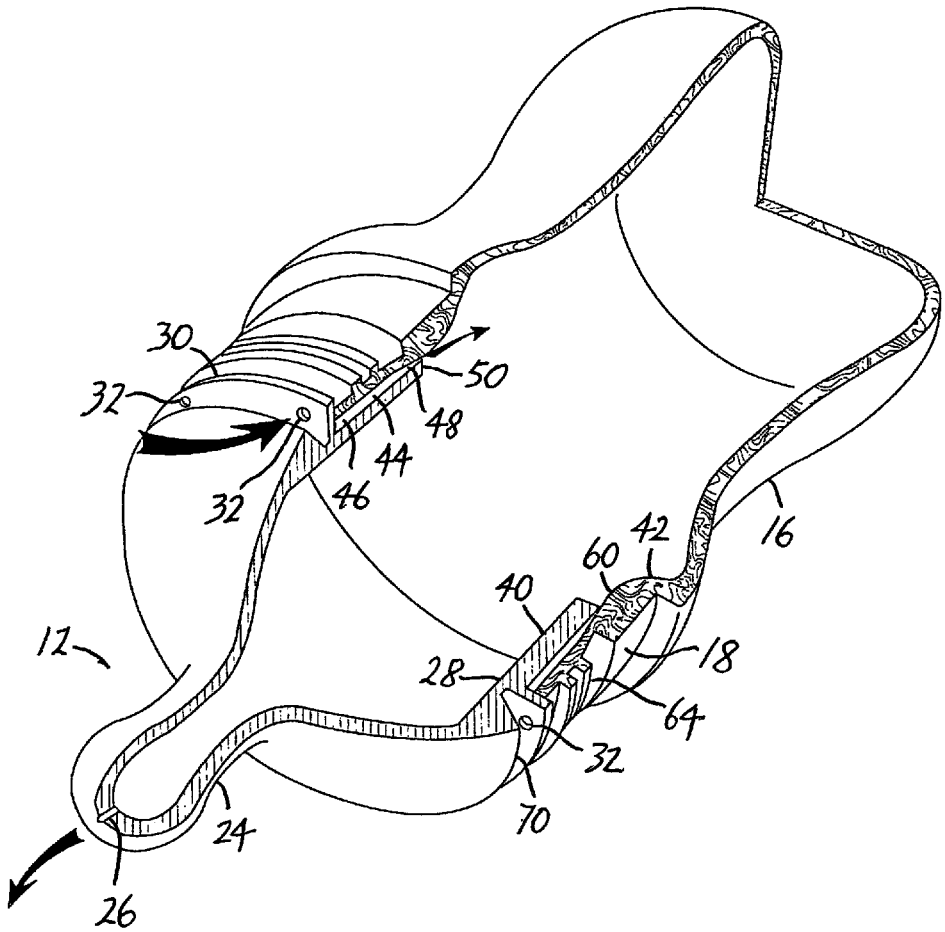
FIG. 6 is a partially cutaway perspective view of the feeding bottle with nipple shown in FIG. 5 in a tilted up side down feeding position with arrows showing the direction of air flow.

As illustrated in FIG. 6, the feeding bottle 10 is held up side down in a tilted feeding position. When the nipple portion 24 is sucked by a baby during feeding, the pressure inside the bottle body 16 drops, outside atmospheric air is drawn through the annular air inlet, at least one of the apertures 32, along the passage 44 and into the bottle body 16 as the air forces at least a portion of the free end 50 of the annular skirt 40 to flex away from the inner surface 42 of the bottle neck 18, thereby opening the inner end 48 of the annular passage 34. Air flows along the sidewall of the bottle neck 18 and the bottle body thereby greatly reducing the amount of air going through the liquid inside the feeding bottle and enhancing the anti-colic effect.

It can be seen that the teat 12, the cap 14 and the bottle body 16 are symmetrical about a central vertical plane of the feeding bottle 10. Since the apertures are formed 360° around the annular flange 30, the anti-colic function works in all directions, i.e. in all positions no matter which side of the feeding bottle is facing upwards. This cannot be achieved by prior art feeding bottle with air passage provided only at one side of the feeding bottle.

Since the feeding bottle 10 has three parts, namely an elastic teat 12, a cap 14 and a bottle body 16, the feeding bottle is simple in construction, easy to use and clean. The teat 12 can be made of silicone and is therefore resistant to high and low temperature, more durable and more suitable for baby products that require high hygienic requirement.

Figure 7:
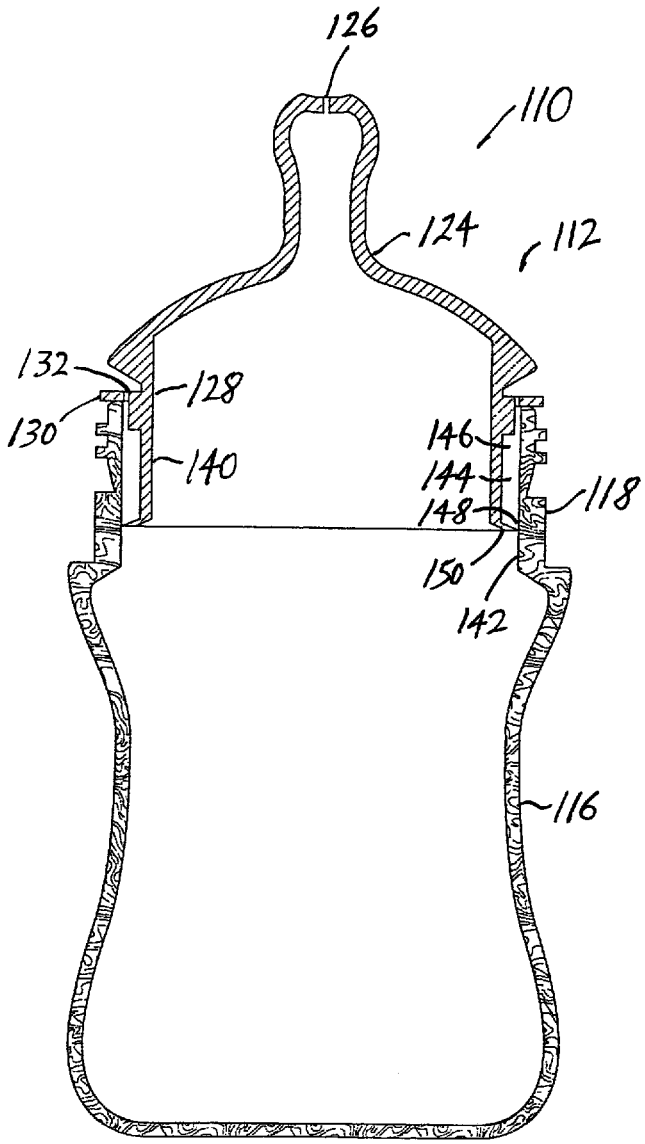
FIG. 7 is a longitudinal cross sectional view of a feeding bottle with nipple according to a second embodiment disclosed in the present application.
Figure 8:
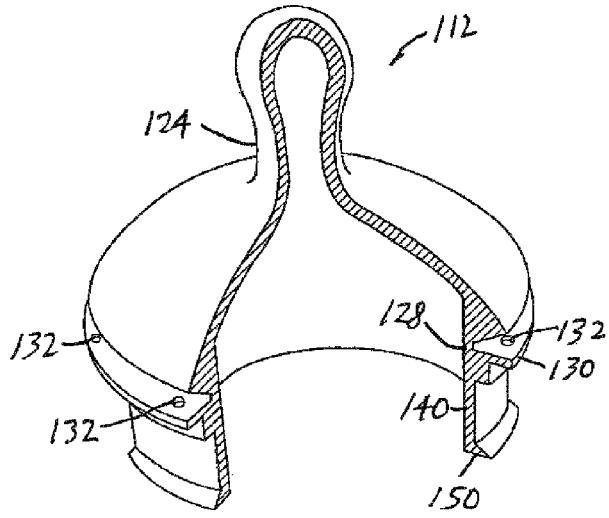
FIG. 8 is a partially cutaway perspective view of the nipple in FIG. 7.
Figure 9:
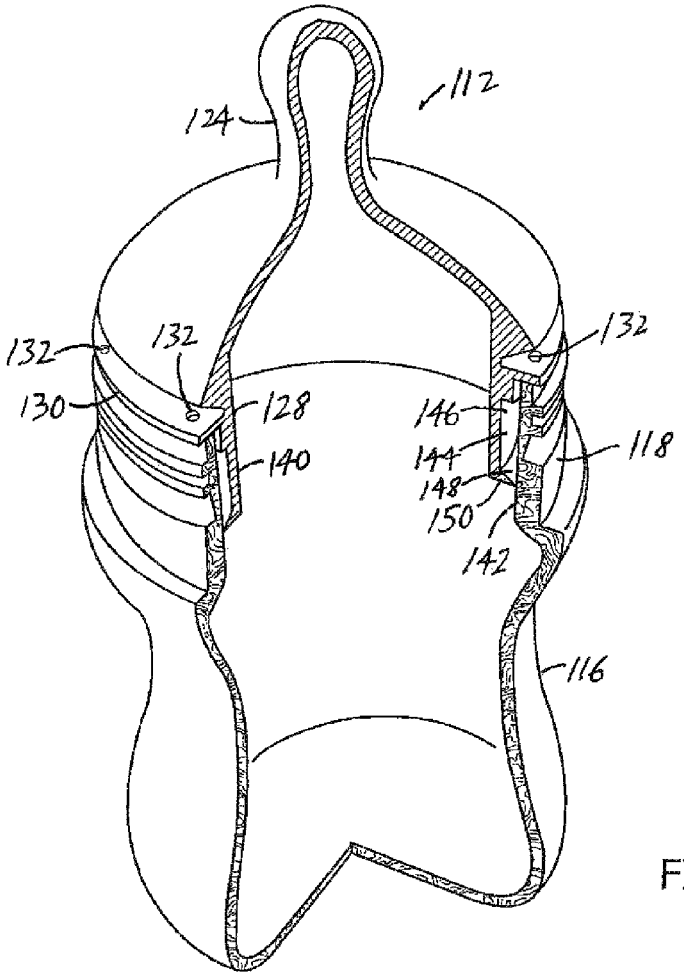
FIG. 9 a partially cutaway perspective view of the feeding bottle with nipple shown in FIG. 7.

FIGS. 7-9 show a feeding bottle 110 according to a second embodiment disclosed in the present application.

Similar to the first embodiment, the teat 112 has a nipple portion 124 having a fluid-dispensing through-hole 126 and an annular base 128. An annular flange 130 may extend radially outwardly from the annular base 128. A plurality of apertures 132 can be formed 360° around the annular flange 130. An annular skirt 140 may depend from the annular base 128 of the nipple portion 124 into the bottle body 116.

The annular skirt 140 can be spaced radially inwardly apart from an inner surface 142 of bottle neck 118 to define an annular passage 144. The annular passage 144 has an outer end 146 in air communication with the apertures 132 and an inner end 148 which is normally closed by biasing force of a free end of the annular skirt 140 pressing against the inner surface 142 of the bottle neck 118.

According to the second embodiment, the annular skirt 140 is generally cylindrical in shape. The annular skirt 140 has a flared free end 150 and the flared free end 150 may have a thickness tapering into a point. In this embodiment, the inner surface 142 of the bottle neck 118 against which the flared free end 150 of the annular skirt 140 presses is vertical and cylindrical in shape.

Figure 10:
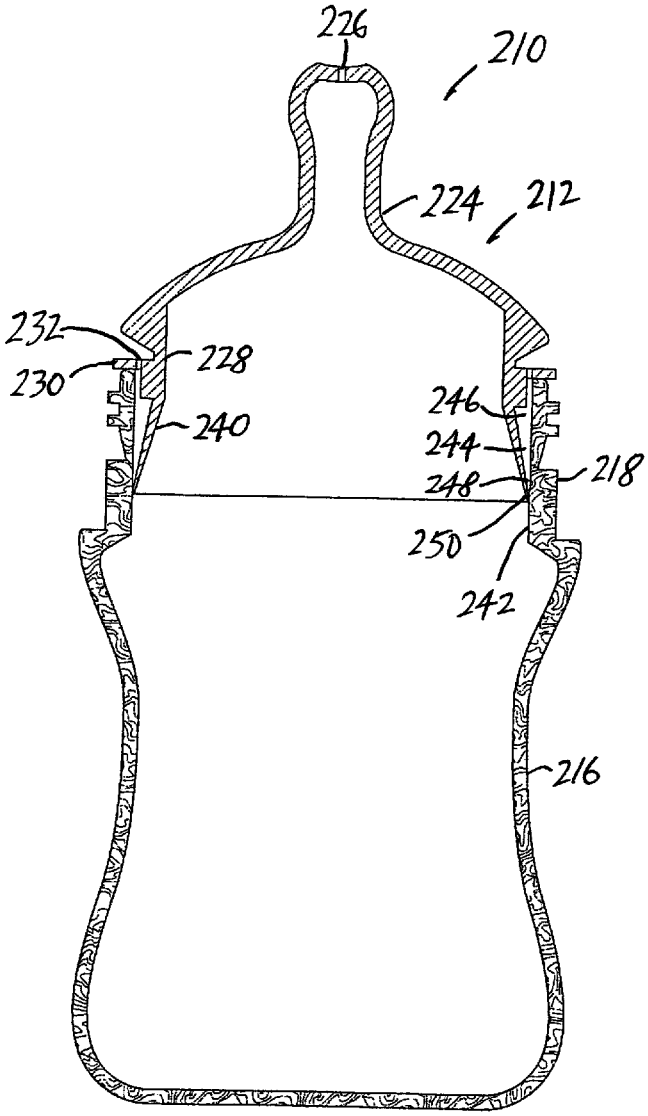
FIG. 10 is a longitudinal cross sectional view of a feeding bottle with nipple according to a third embodiment disclosed in the present application.
Figure 11:
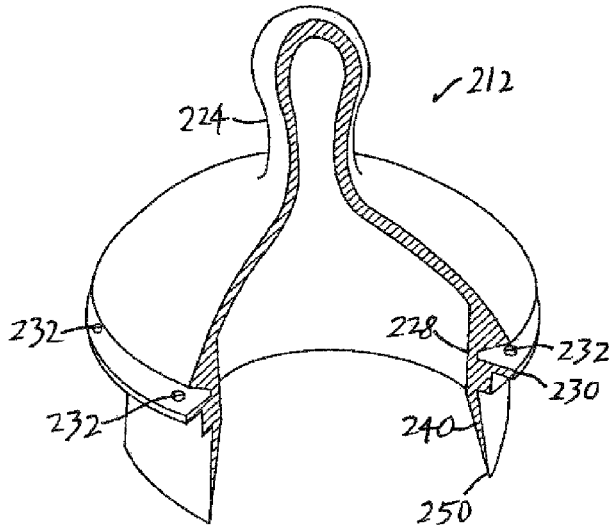
FIG. 11 is a partially cutaway perspective view of the nipple in FIG. 10.
Figure 12:
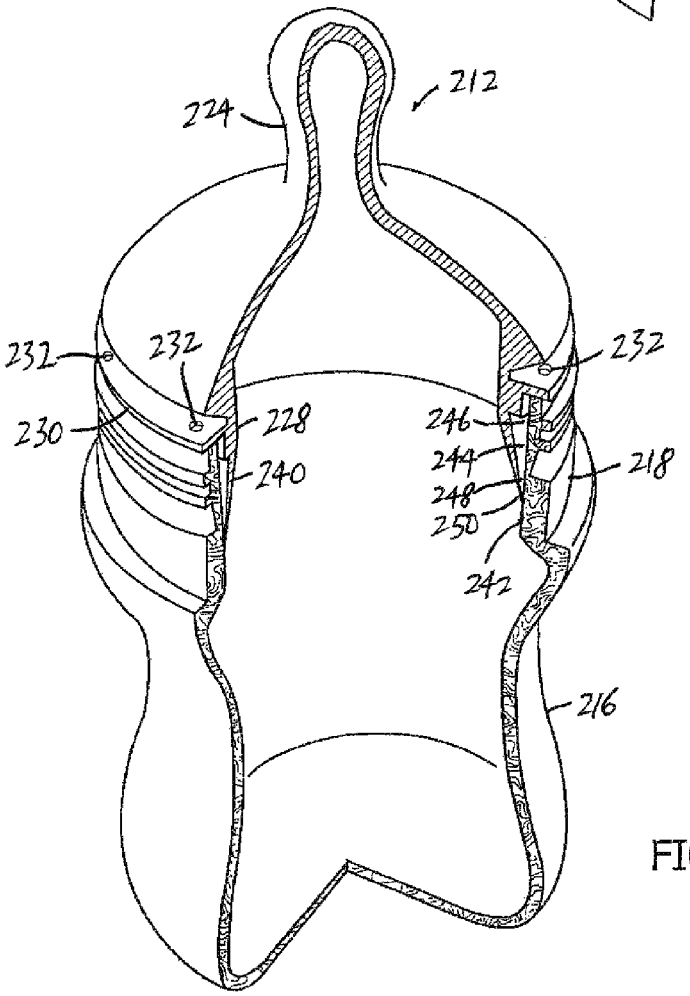
FIG. 12 is a partially cutaway perspective view of the feeding bottle with nipple shown in FIG. 10.

FIGS. 10-12 show a feeding apparatus 210 according to a third embodiment disclosed in the present application. Again, the closure cap of the feed apparatus 210 in the third embodiment is the same as the closure cap 14 in the first embodiment and is not shown the figures.

Similar to the first embodiment, the teat 212 has a nipple portion 224 having a fluid-dispensing through-hole 226 and an annular base 228. An annular flange 230 may extend radially outwardly from the annular base 228. A plurality of apertures 232 can be formed 360° around the annular flange 230. An annular skirt 240 may depend from the annular base 228 of the nipple portion 224 into the bottle body 216.

The annular skirt 240 can be spaced radially inwardly apart from an inner surface 242 of bottle neck 218 to define an annular passage 244. The annular passage 244 has an outer end 246 in air communication with the apertures 232 and an inner end 248 which is normally closed by biasing force of a free end of the annular skirt 240 pressing against the inner surface 242 of the bottle neck 218.

According to the third embodiment, the annular skirt 140 flares from the annular base 228 to the free end 250. The thickness of the annular skirt 140 may taper to a point. In this embodiment, the inner surface 242 of the bottle neck 218 against which the free end 250 of the annular skirt 240 presses is vertical and cylindrical in shape.

While the feeding bottle disclosed in the present application has been shown and described with particular references to a number of preferred embodiments thereof, it should be noted that various other changes or modifications may be made without departing from the scope of the appending claims.

What is claimed is:

1. An anti-colic baby feeding bottle comprising:

a bottle body comprising a bottle neck;

a cap removably fastened to the bottle neck; and an elastic teat comprising a nipple portion comprising a fluid-dispensing through-hole and an annular base, an annular flange extending radially outwardly from the annular base, a lurality of apertures formed 360° around the annular flange, and an annular skirt depending from the annular base;

wherein the annular flange is clamped between an annular top wall of the cap and a rim of the bottle neck, and the annular skirt is spaced radially inwardly apart from an inner surface of the bottle neck to define an annular passage comprising an outer end in air communication with the apertures and an inner end which is normally closed by biasing force of a free end of the annular skirt that presses against the inner surface of the bottle neck;

wherein the annular skirt is generally cylindrical in shape; and wherein the inner surface of the bottle body against which the free end of the annular skirt presses is a radially inwardly bulging annular protrusion.

2. The feeding bottle as claimed in claim 1, wherein when the bottle is held in a feeding position and the nipple portion is sucked, the pressure inside the bottle body drops, thereby drawing outside atmospheric air through at least one of the apertures, along the passage and into the bottle body as the air forces at least a portion of the free end of the annular skirt to flex away from the inner surface of the bottle neck thereby opening the inner end of the passage.

3. The feeding bottle as claimed in claim 1, wherein the nipple portion further comprises an annular projection which together with the annular top wall of the cap defines an annular air inlet in air communication with the apertures.

4. The feeding bottle as claimed in claim 1, wherein the apertures are formed around the annular flange adjacent to the annular base of the nipple portion.

5. The feeding bottle as claimed in claim 1, wherein the bottle neck is integrally formed with external threads and the cap is integrally formed with internal threads threadably engagable with the external threads.

6. A teat for a feeding bottle comprises:

a nipple portion comprising a fluid-dispensing through-hole and an annular base;

an annular flange extending radially outwardly from the annular base;

a plurality of apertures formed 360° around the annular flange; and an annular skirt depending from the annular base;

wherein the annular flange is adapted to be clamped between a bottle neck of a bottle body and a cap removably fastened to the bottle neck, and the annular skirt is spaced radially inwardly apart from an inner surface of the bottle neck to define an annular passage comprising an outer end in air communication with the apertures and an inner end which is normally closed by biasing force of a free end of the annular skirt that presses against the inner surface of the bottle neck;

wherein the annular skirt is generally cylindrical in shape; and wherein the inner surface of the bottle body against which the free end of the annular skirt presses is a radially inwardly bulging annular protrusion.

7. The teat as claimed in claim 6, wherein the nipple portion further comprises an annular projection which together with the annular top wall of the cap defines an annular air inlet in air communication with the apertures.

8. The teat as claimed in claim 6, wherein the apertures are formed around the annular flange adjacent to the annular base of the nipple portion.

* * * * *